US005521686A

United States Patent [19]

Muto

[11] Patent Number: 5,521,686

[45] Date of Patent: May 28, 1996

[54] ELECTROPHOTOGRAPHIC IMAGE FORMING METHOD AND APPARATUS WHEREIN IMAGE FIXING HEATER TEMPERATURE IS CONTROLLABLE

[75] Inventor: Kiyoshi Muto, Yokkaichi, Japan

[73] Assignee: Brother Kogyo Kabushiki Kaisha, Japan

[21] Appl. No.: 323,723

[22] Filed: Oct. 18, 1994

[30] Foreign Application Priority Data

Oct. 20, 1993 [JP] Japan ..... 5-262110

[51] Int. Cl.[6] ..... G03G 15/20

[52] U.S. Cl. ..... 355/285; 219/216

[58] Field of Search ..... 355/285, 282; 219/216, 240, 241

[56] References Cited

U.S. PATENT DOCUMENTS 4,671,643 6/1987 Shigemura et al. .

4,868,368 9/1989 Araki ..... 219/216

5,241,349 8/1993 Nagasaka ..... 355/285

5,321,478 6/1994 Nakamura et al. ..... 355/285

*Primary Examiner*—R. L. Moses

*Attorney, Agent, or Firm*—Oliff & Berridge

[57] ABSTRACT

An electrophotographic image forming system wherein a visible image is generated by an image forming device in response to a print start command and is fixed on the medium by heat generated by a heater. The temperature of the heater is controlled in a temperature-control-on mode and not controlled in a temperature-control-off mode. A controller is provided for controlling the heating device in the temperature-control-on mode such that the temperature is held at a first level when the apparatus is in a stand-by mode before the print start command is received, and at a second level higher than the first level when the apparatus is in a printing mode with the image forming device being operated. The controller changes the temperature-control-off mode to the temperature-control-on mode to control the temperature to be held at the second level and establish the printing mode without establishing the stand-by mode, when the print start command is received in the temperature-control-off mode.

17 Claims, 5 Drawing Sheets

ELECTROPHOTOGRAPHIC IMAGE FORMING METHOD AND APPARATUS WHEREIN IMAGE FIXING HEATER TEMPERATURE IS CONTROLLABLE

BACKGROUND OF THE INVENTION

1. Field of the Invention

The present invention relates to a method and an apparatus for forming an image by electrophotography, wherein the temperature of an image fixing heating device is controllable in a temperature-control-on mode and non-controllable in a temperature-control-off mode. More particularly, the invention is concerned with such electrophotographic image forming method and apparatus which permit a new image forming job to be started in a relatively short time after the last image forming job which is requested while the apparatus is in the temperature-control-off mode.

2. Discussion of the Related Art

A known apparatus such as a laser printer having an image forming device adapted to form a visible image by electrophotography is generally provided with a heating device for applying heat to a recording medium for fixing the visible image on the recording medium. The temperature adjacent to or within the heating device is controlled to be held at a first level (stand-by temperature) when the apparatus is in a stand-by mode without a print start command being received, and at a second level (image fixing temperature) higher than the first level when the apparatus is in a printing mode with an image forming operation being performed.

For instance, the heating device has a heat generator in the form of a halogen lamp, which is turned on and off to control the temperature adjacent to the heating device. The amount of consumption of electric power required for the heating device is as large as 70–80% of the total amount of electric power required for the apparatus. This means a considerable waste of energy while the apparatus is in the stand-by mode in which the heating device is controlled to hold its temperature at the first level indicated above. To minimize this waste, it has been proposed to provide means for providing a temperature-control-off mode if the apparatus is held in the stand-by mode for more than a predetermined time, namely, if print data (with a print start command) have not been received from an external device for more than the predetermined time, or alternatively if an appropriate operator-controlled switch is operated. The heating device is controlled to control the heating temperature in the temperature-control-on mode, and is not controlled in the temperature-control-off mode.

In the apparatus having the temperature-control-on mode and temperature-control-off mode as described above, the amount of waste of the electric power is reduced since the heating device is held off after a predetermined time has passed without a print start command being received or after the appropriate switch is operated.

When the above apparatus receives a print start command with print data from an external device, the temperature adjacent to the heating device is first controlled to be held at the predetermined first level (stand-by temperature), and then a scanner motor for sweeping an image beam on the basis of the print data is started. The temperature is then controlled to be held at the second level (predetermined image fixing temperature).

If the print start command and print data are received from the external device after the temperature-control-off mode is established, the heating device is first turned on to raise the temperature to the first level, and the scanner motor is then turned on. The temperature is then further controlled to be raised to the second level or nominal image fixing temperature. In other words, the scanner motor is not turned on until the temperature has reached the first level, that is, the scanner motor is not turned on as soon as the print start command is received. Accordingly, it takes a relatively long time for the temperature of the heating device to be raised to the image fixing level and for the image forming operation to be started (on the first sheet of paper, for example) after the print command is received in the temperature-control-off mode.

SUMMARY OF THE INVENTION

It is therefore a first object of the present invention to provide a method of forming an image by electrophotography, which permits temperature control of an image fixing heating device in a temperature-control-on mode and inhibits the temperature control in a temperature-control-off mode, and which also permits an image forming operation to be started in a relatively short time after a print start command is received in the temperature-control -off mode.

It is a second object of this invention to provide an electrophotographic image forming apparatus which is suitable for practicing the method described above.

The first object indicated above may be achieved according to a first aspect of this invention, which provides a method of forming an image by an electrophotographic image forming apparatus, comprising the steps of: (a) generating a visible image on a recording medium in respose to a print start command; (b) applying heat to the recording medium for fixing the visible image on the recording medium; (c) detecting a temperature adjacent to a heating device for generating said heat; (d) selectively establishing one of a temperature-control-on mode in which the temperature is controlled by a heating device, and a temperature-control- off mode in which the temperature is not controlled; (e) controlling the temperature in the temperature-control-on mode to be held at a first level when the apparatus is in a stand-by mode without said print start command being received, and at a second level higher than the first level when the apparatus is in a printing mode with the visible image being generated in response to said print start command and fixed by the heat generated y said heating device; and (f) changing the temperature-control-off mode to the temperature-control-on mode to control the temperature to be held at the second level and establishing the printing mode without establishing the stand-by mode, when the print start command is received in the temperature-control-off mode.

The second object indicated above may be achieved according to a second aspect of the invention, which provides an electrophotographic image forming apparatus suitable for practicing the method described above, the apparatus comprising: (i) an image forming device for generating a visible image on a recording medium according to print data and in response to a print start command; (ii) a heating device for generating heat applied to the recording medium for fixing the visible image on the recording medium; (iii) a temperature detector for detecting a temperature adjacent to the heating device; (iv) a mode setter for selectively establishing one of a temperature-control-on mode in which the heating device is controlled to control the temperature, and a temperature-control-off mode in which the heating device is not controlled; and (v) a controller responsive to the mode setter, for controlling the heating device in the temperature-control-on mode such that the temperature is held at a first level when the apparatus is in a stand-by mode without the print start command being received, and at a second level higher than the first level when the apparatus is in a printing mode with the image forming device being operated in respose to the printing command, the controller holding the heating device in an off state when the temperature- control-off mode is selected, the controller changing the temperature-control-off mode to the temperature-control-on mode to control the temperature to be held at the second level and establishing the printing mode without establishing the stand-by mode, when the print start command is received in the temperature-control-off mode.

In the electrophotographic image forming apparatus of the present invention constructed as described above to practice the method described above, the heating device is controlled in the temperature-control-on mode by the controller such that the temperature adjacent to or within the heating device is held at the first level when the apparatus is in the stand-by mode, namely, before a print start command is received, and at the second level when the apparatus is in the printing mode with the image forming device being operated in response to the print start command. When the print start command is received while the apparatus is in the temperature-control-off mode, the controller changes the temperature-control-off mode to the temperature-control-on mode so as to control the temperature to be held at the second level, and establishing the printing mode without establishing the stand-by mode, so that the temperature of the heating device is raised directly to the second level.

According to the present method and apparatus, the amount of electric power consumption by the heating device is reduced, since the heating device is held in its off state while the apparatus is in the temperature-control-off mode, which is established by the mode setter, for example, if the apparatus is in the stand-by mode for more than a predetermined time, that is, if no print start command is received for more than a predetermined time. Further, the temperature of the heating device is raised directly to the second level when the print start command is received from an external device, even if the print start command is received while the apparatus is in the temperature-control-off mode. In this case, the heating device is turned on by the controller as soon as the print start command has been received, and is held on until the temperature adjacent to the heating device is raised to the second level, namely, to the predetermined image fixing temperature, without the apparatus being once placed in the stand-by mode. Accordingly, the image forming operation can be started in a comparatively short time after the print start command is received in the temperature-control-off mode of the apparatus.

The apparatus may further comprise a print-mode setter for establishing the printing mode when said print start command is received irrespective of whether the apparatus is placed in the temperature-control-on mode or the temperature-control-off mode, and establishing the stand-by mode after an operation of the image forming device is completed.

The mode setter may be adapted to establish the temperature-control-off mode if the apparatus is held in the stand-by mode for more than a predetermined time, or if an appropriate operator-controlled switch is operated.

The controller may be adapted to compare the temperature detected by the temperature detector with the first level to control the heating device in the temperature-control-on mode when the apparatus is in the stand-by mode, and with the second level when the image forming device is in operation. These first and second levels may be represented by reference values of the output of the temperature detector, which are stored in suitable memory.

The apparatus may further comprise a scanning device for generating a latent image according to print data. In this case, the visible image is generated by the image forming device on the basis of the latent image. The controller may be adapted to command the image forming device to start an image forming operation after an operating speed of the scanning device is raised to a predetermined level after the temperature adjacent to the heating device is raised to the second level.

The scanning device may comprise a scanner motor for driving a polygon mirror for sweeping a laser beam modulated on the basis of the print data.

The controller may comprise a memory for storing a main control routine for controlling an operation of the apparatus. The main control routine includes a temperature control sub-routine for controlling the temperature in the temperature-control-on mode and not controlling the temperature in the temperature-control-off mode. The main control routine further includes a print control sub-routine executed when the print start command is received. The print control sub-routine is formulated to change the temperature-control-off mode to the temperature-control-on mode and execute the temperature control sub-routine so that the temperature is controlled to be held at the second level when the print control sub-routine is executed.

In one preferred arrangement of the above form of the invention, the temperature-control mode setter may comprise a temperature-control-off flag which is used in the temperature-control sub-routine to determine whether the apparatus is placed in the temperature-control-off mode or the temperature-control-on mode. The temperature-control-off flag is reset in the print control sub-routine to establish the temperature-control-on mode immediately after the print control sub-routine is initiated in response to the print start command. In this case, the controller may use a print-mode flag which is set in the print control sub-routine to establish the printing mode immediately after the print control sub-routine is initiated in response to the print start command, so that the temperature of the heating device is controlled to be held at the second level when the temperature control sub-routine is executed in the print control sub-routine. This print-mode flag is reset immediately before the print-control sub-routine is terminated.

The image forming device may use a photosensitive drum on which the visible image is produced, and an image transfer device for transferring the visible image from the photosensitive drum onto the recording medium.

The heating device may comprise a heating roller incorporating a heat generator, so that the recording medium is fed in rolling contact with the heating roller for fixing the visible image on the recording medium.

BRIEF DESCRIPTION OF THE DRAWINGS

The above and other objects, features and advantages of this invention will be better understood by reading the following detailed description of a presently preferred embodiment of the invention, when considered in connection with the accompanying drawings, in which.

DETAILED DESCRIPTION OF THE PREFERRED EMBODIMENT

Figure 1:
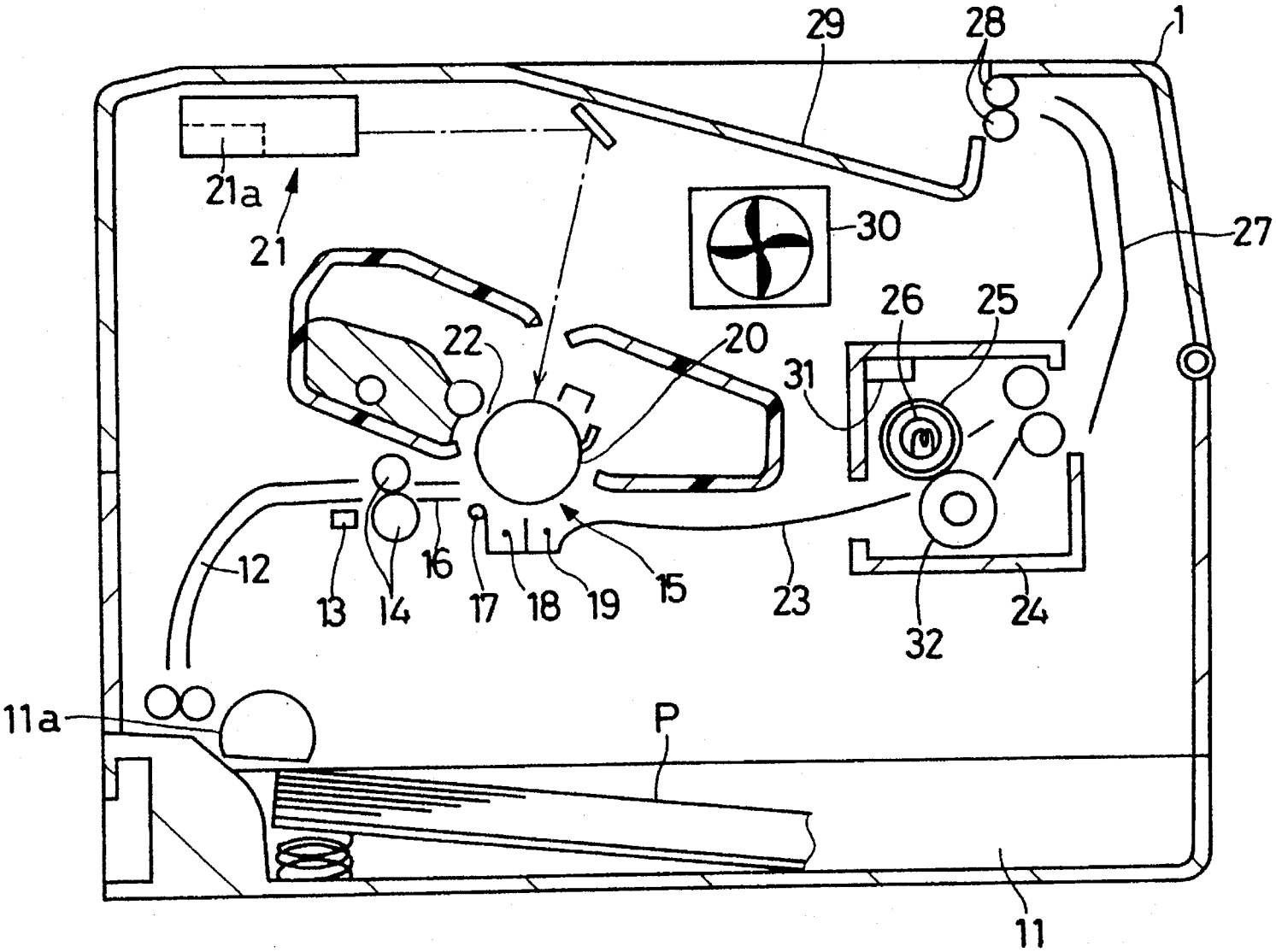
FIG. 1 is a schematic elevational view in cross section of an electrophotographic image forming apparatus in the form of a laser printer constructed according to one embodiment of the present invention.
Figure 2:
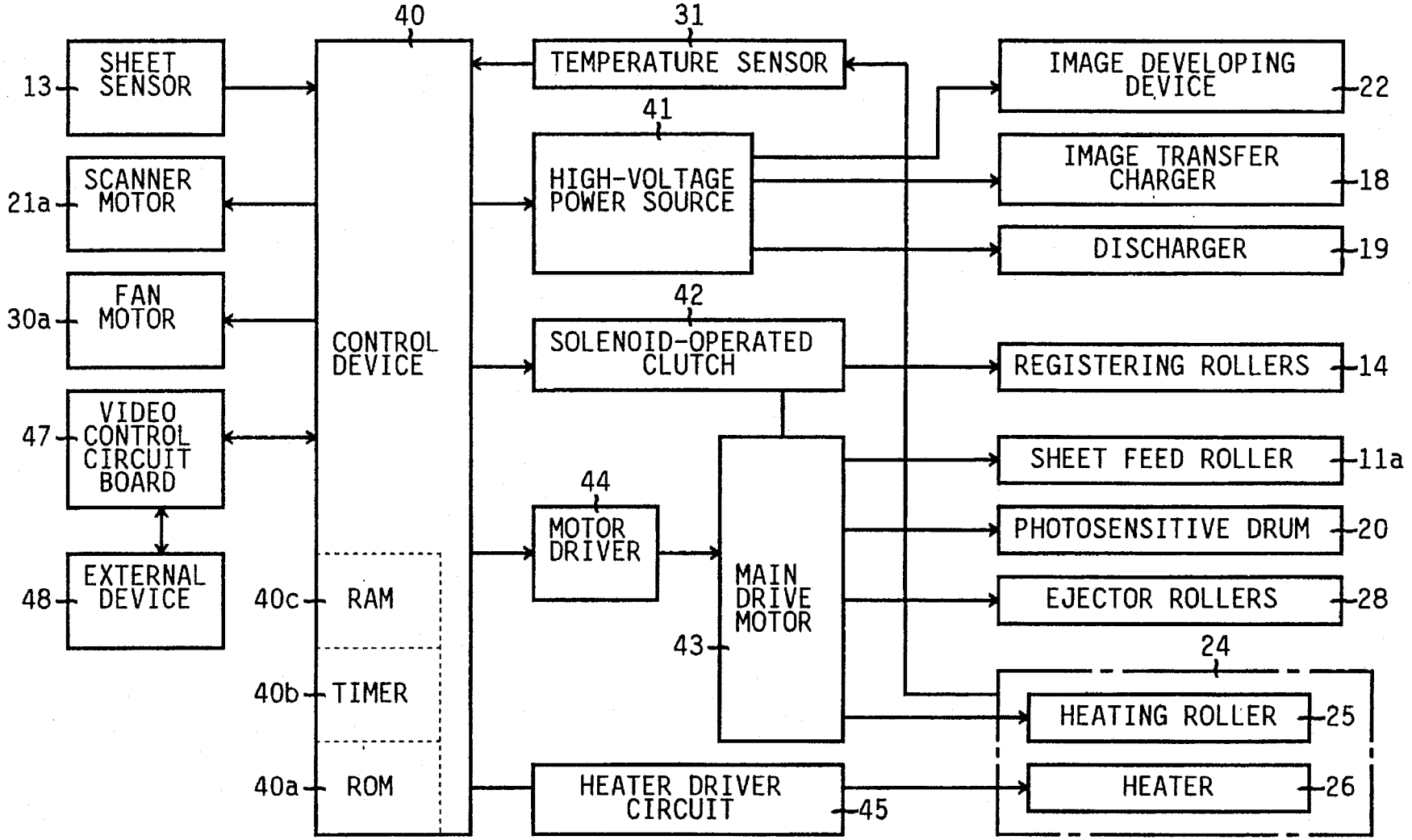
FIG. 2 is a block diagram illustrating an electric control system of the laser printer of FIG. 1.

Referring first to FIGS. 1 and 2, there will be described a laser printer as one embodiment of an electrophotographic image forming apparatus of the present invention.

The laser printer, which is schematically shown in FIG. 1, is equipped with a paper supply 11 disposed in a lower section of a body 1. The paper supply 11 includes a sheet feed roller 11*a* for feeding sheets of paper P toward an image forming assembly indicated generally at 15. The body 15 also houses a first sheet guide 12, a sheet sensor 13, and a pair of registering rollers 14, which are arranged downstream of the paper supply 11, in the order of description.

The paper sheet P delivered from the paper supply 11 by means of the feed roller 11*a* is fed to the registering rollers 14 while it is guided by the first sheet guide 13. The sheet sensor 13 is provided to detect a passage of the sheet P toward the registering rollers 14, so that the registering rollers 14 are rotated a predetermined time after the passage of the sheet P is detected by the sheet sensor 13. The registering rollers 14 are adapted to register the sheet P, so as to remove a skew of the sheet P, if any, while the sheet P is in contact with the rollers 14.

A second sheet guide 16 and a guide roller 17 are disposed downstream of the registering rollers 14, so that the sheet P fed by the rotating registering rollers 14 is guided by the guide 16 and roller 17, and is thereby brought into contact with a photosensitive (photoconductive) drum 20 of the image forming assembly 15. The guide roller 17 is located adjacent to the circumference of the drum 20 so that a visible image formed on the surface of the drum 20 is transferred onto a surface of the sheet P while the sheet P is pressed by the guide roller 17 against the surface of the drum 20.

The image forming assembly 15 is disposed in upper left and central sections of the body 1. The image forming assembly 15, which includes the photosensitive drum 20 as indicated above, also includes a scanner unit 21, an image developing device 22, an image transfer charger 18, and a discharger 19. The scanner unit 21 is located in the upper left corner of the body 1, and is adapted to imagewise expose the surface of the drum 20 so as to form an electrostatic latent image corresponding to an image to be reproduced, as well known in the art. The scanner unit 21 includes a scanner motor 21*a* for driving a polygon mirror for sweeping a laser beam which has been modulated on the basis of print data representative of an image to be reproduced. The latent image consists of electrostatically charged areas of the surface of the drum 20. The image developing device 22 is provided to apply a toner to the electrostatically charged areas of the surface of the drum 20, for thereby forming a visible image which consists of the toner. The image transfer charger 18 is provided to electrostatically charge the sheet P so that the visible toner image is transferred from the surface of the drum 20 onto the recording surface of the sheet P. The discharger 19 is provided to electrostatically discharge the sheet P so that the sheet P is separated from the surface of the drum 20. Thus, the visible toner image is transferred from the drum 20 to the sheet P while the sheet P is passed between the drum 20 and the charger and discharger 18, 19.

Below and downstream of the image forming assembly 15, there are disposed a third sheet guide 23 and an image fixing heating device 24. The sheet P fed from the image forming assembly 15 is fed into the heating device 24 while the sheet P is guided by the third sheet guide 23. A fourth sheet guide 27 and a pair of ejector rollers 28 are disposed downstream of the image fixing heating device 24. The sheet P leaving the heating device 24 is fed to the ejector rollers 28 while the sheet P is guided by the fourth sheet guide 27. The ejector rollers 28 are adapted to deliver the sheet P onto a tray 29 provided in an upper section on the body 1.

The image fixing heating device 24 includes a heating roller 25 incorporating a heater 26 in the form of a halogen lamp. The heating roller 25 cooperates with a pressing roller 32 to define a pressure nip therebetween, so that the sheet P is fed through the pressure nip. The heating roller 25 is heated by energization of the heater 26. The heating device 24 further includes a temperature sensor 31 to detect the temperature within the heating device 24, more specifically, the temperature adjacent to the heating roller 25.

Near the heating device 24, there is disposed a cooling fan device 30 for discharging hot air from the inside of the body 1 into the atmosphere, that is, for cooling the interior of the body 1 so as to protect the scanner unit 21 and the other components of the image forming assembly 15 against abnormality due to an excessive rise of the temperature within the body 1.

Referring next to the block diagram of FIG. 2, an electric control system of the laser printer will be described.

The control system includes a control device 40, which is constituted by a microcomputer incorporating a central processing unit, a read-only memory 40*a*, a random-access memory, a timer 40*b*, an A/D converter, a random-access memory 40*c*, and a bus connecting those components. The read-only memory 40*a* stores various control programs such as a main routine illustrated in the flow chart of FIG. 3, and various sorts of data such as data representative of a first and a second reference voltage Vr1 and Vr2. The timer 40*b* is adapted to measure the stand-by time of the laser printer, that is, a non-printing time of the laser printer after the laser printer is initially turned on or after the last printing operation or job is completed. The random-access memory 40*c* includes a TEMPERATURE CONTROL Off flag and a PRINT MODE flag, which will be described.

The reference voltages Vr1 and Vr2 correspond to a predetermined first level or stand-by temperature T1 and a predetermined second level or image fixing temperature T2, respectively. As described below, the heater 26 is controlled so that the temperature of the heating roller 25 is kept at the stand-by temperature T1 when the laser printer is in a stand-by mode, and at the image fixing temperature T2 when the laser printer is in a printing mode, namely, in an image forming operation or job. As explained below in detail, an output voltage V of the temperature sensor 31 is compared with these reference voltages Vr1, Vr2 to determine whether the temperature of the heating roller 25 is higher or lower than the stand-by and image fixing temperatures T1, T2.

To the control device 40, there are connected the above-described scanner unit 21, sheet sensor 13, cooling fan device 30 and temperature sensor 31, and a high-voltage power source, a solenoid-operated clutch 42, a motor driver 44, a heater driver circuit 45 and a video control circuit board 47.

The high-voltage power unit 41 is connected to the above-indicated image developing device 22, image transfer charger 18 and discharger 19, and applies different levels of voltage to these devices 22, 18, 19 under the control of the control device 40.

The motor driver 44 is provided for driving a main motor 43, which is operatively connected to the sheet feed roller 11*a*, photosensitive drum 20, ejector rollers 28 and heating roller 25, through a power transmission gear trains. The main motor 43 is also connected to the registering rollers 14 through the solenoid-operated clutch 42, which is selectively placed in an engaged position or a released position under the control of the control device 40.

The heater driver circuit 45 is provided to energize the heater 26. The control device 40 turns on and off the heater 26 via the driver circuit 45, depending upon the output voltage of the temperature sensor 31.

The sheet sensor 13 feeds a signal to the control device 40 when the sheet P is moved over the sensor 13. The control device 40 energizes the solenoid of the solenoid-operated clutch 42 to place the clutch 42 in the engaged position, for transmitting the rotary motion of the main motor 43 to the registering rollers 14, when a predetermined time has elapsed after the generation of the signal from the sheet sensor 13.

The cooling fan device 30 has a motor 30*a* for rotating a cooling fan. The motor 30*a* is controlled by the control device 40 such that the motor 30*a* is held on to dissipate heat generated by the image fixing heating device 24 when the laser printer is in operation, and held off when the laser printer is in the stand-by mode. The temperature sensor 31 applies its output voltage V to the control device, and the voltage V is compared by the control device 40 with the reference voltages Vr1, Vr2 described above, so that the heater 26 is turned on and off as a result of the comparison.

The video control circuit board 47 is adapted to generate print data on the basis of character data, printing control data and other data received from an external device 48. The generated print data are fed from the circuit board 47 to the control device 40, together with a PRINT START command, so that the control device 40 controls the scanner unit 21 and other components of the laser printer according to the print data, in response to the PRINT START command which requires a printing job to be started according to the print data.

Figure 3:
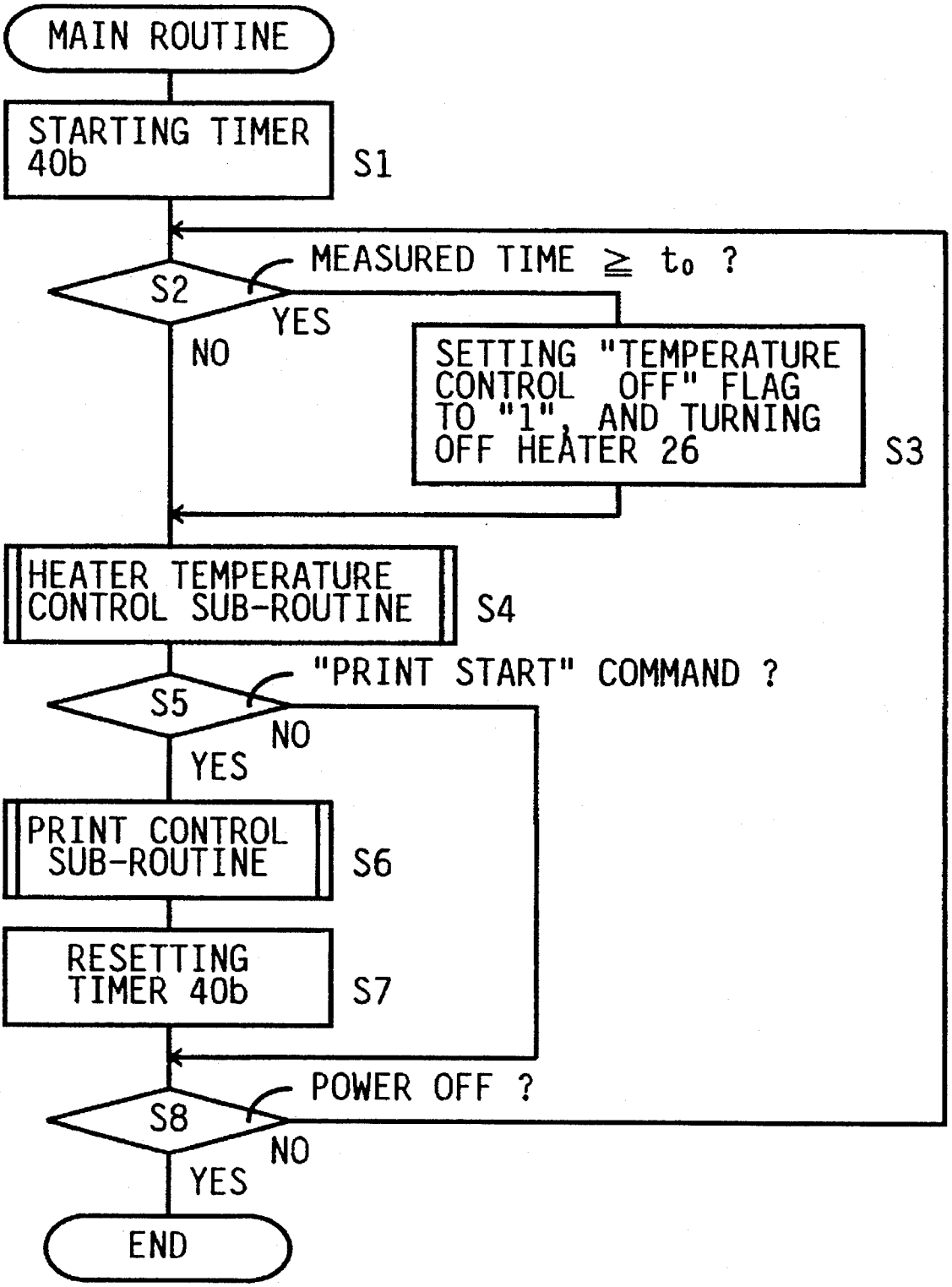
FIG. 3 is a flow chart showing a main control routine executed by the laser printer of FIG. 1.

Referring to the flow chart of FIGS. 3–5, there will next be described an operation of the laser printer constructed as described above. Upon application of power to the laser printer, the printer is initialized, and the control device 40 executes a main control routine as illustrated in the flow chart of FIG. 3.

The main control routine is initiated with step S1 to start the timer 40*b* for measuring the stand-by time of the laser printer during which no PRINT START command is received from the video control circuit board 47. Step S1 is followed by step S2 to determine whether the time measured by the timer 40*b* has reached a predetermined value, that is, whether a predetermined time $t_0$ (for example, five minutes) has elapsed. If an affirmative decision (YES) is obtained in step S2, the control flow goes to step S3 to set a TEMPERATURE CONTROL OFF flag to "1", and turn off the heater 26. In this case, the laser printer is placed in a TEMPERATURE-CONTROL-OFF mode. If a negative decision (NO) is obtained in step S2, namely, if the predetermined time $T_0$ has not elapsed, the control flow goes to step S4 in which a TEMPERATURE CONTROL sub-routine of FIG. 4 is executed as described below. Step S4 is followed by step S5 to determine whether the PRINT START command has been received. If an affirmative decision (YES) is obtained in step S5, the control flow goes to step S6 to execute a PRINT CONTROL sub-routine of FIG. 5 as described below. If a negative decision (NO) is obtained in step S5, the control flow goes to step S8, skipping steps S6 and S7. Step S7 following step S6 is provided to reset the timer 40*b* and start measuring the stand-by time of the laser printer again. Step S7 is followed by step S8. In step S8, the control device 40 determines whether power has been removed from the laser printer. If an affirmative decision (YES) is obtained in step S8, the main routine is terminated, and the printer is turned off. If a negative decision (NO) is obtained, the control flow goes back to step S2.

Figure 4:
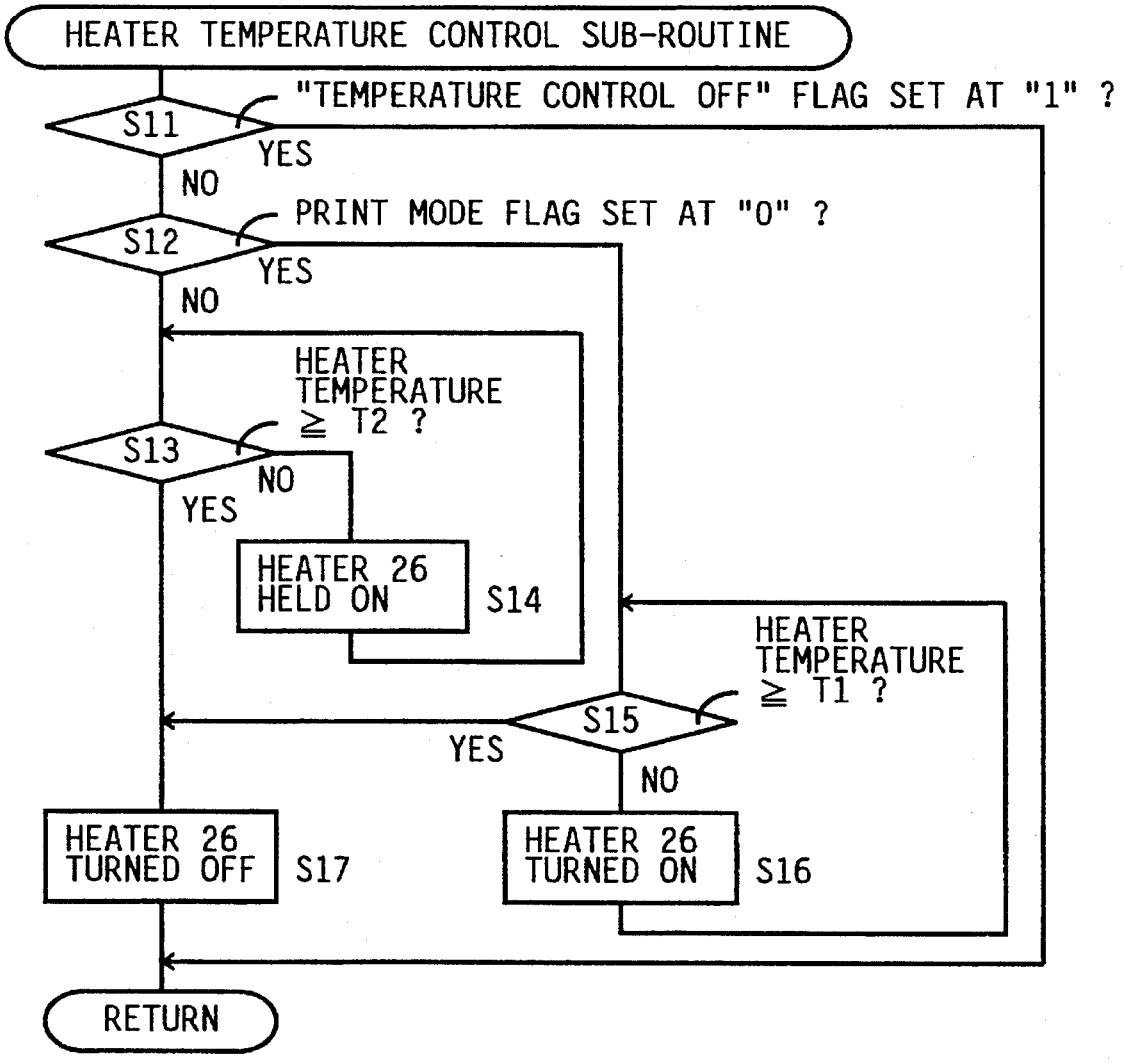
FIG. 4 is a flow chart showing a HEATER TEMPERATURE CONTROL sub-routine executed in the main control routine of FIG. 3 to control the temperature of an image fixing heating device of the laser printer.

Reference is now made to the flow chart of FIG. 4, the TEMPERATURE CONTROL sub-routine for controlling the temperature of the heating device 24 is initiated with step S11 to determine whether the TEMPERATURE CONTROL OFF flag is set at "1". If an affirmative decision (YES) is obtained in step S11, that is, if the laser printer is in the TEMPERATURE-CONTROL-OFF mode with the heater 26 held off, the sub-routine of FIG. 4 is terminated.

If the TEMPERATURE CONTROL OFF flag is set at "0", that is, if the laser printer is in a TEMPERATURE-CONTROL-ON mode, a negative decision (NO) is obtained in step step S11, whereby the control flow goes to step S12 to determine whether the PRINT MODE flag is set at "0", that is, whether the laser printer is in the stand-by mode. The PRINT MODE flag is set at "1" and reset to "0" in steps S22 and S29, respectively, in the print control sub-routine of FIG. 5. If an affirmative decision (YES) is obtained in step S12, namely, if the stand-by mode is currently established, step S15 is implemented. If a negative decision (NO) is obtained in step S12, that is, if the laser printer is in the printing mode with the PRINT MODE flag set at "1" in response to a PRINT START command, the control flow goes to step S13.

In step S15, the control device 40 reads the output voltage V of the temperature sensor 31, and compares the voltage V with the first reference voltage Vr1. Thus, step S15 is provided to determine whether the temperature of the heating roller 25 as detected by the temperature sensor 31 is equal to or higher than the predetermined stand-by temperature T1. If an affirmative decision (YES) is obtained in step S15, step S17 is implemented to turn off the heater 26. If a negative decision (NO) is obtained in step S15, that is, if the detected temperature of the heater roller 25 is lower than the stand-by temperature T1 corresponding to the first reference voltage Vr1, step S16 is implemented to turn on the heater 26 or hold the heater 26 in the on state. In this case, step S16 is followed by step S15. Steps S15 and S16 are repeatedly implemented until the temperature of the heating roller 25 is raised to the predetermined stand-by temperature T1.

Step S13 implemented when the laser printer is in a printing operation (started by the PRINT START command) is formulated to compare the output voltage V of the temperature sensor 31 with the second reference voltage Vr2, that is, determine whether the temperature of the heating roller 25 as detected by the temperature sensor 31 is equal to or higher than the predetermined image fixing temperature T2. If an affirmative decision (YES) is obtained in step S13, step S17 described above is implemented to turn off the heater 26. If a negative decision (NO) is obtained in step S13, that is, if the detected temperature of the heater roller 25 is lower than the image fixing temperature T1 corresponding to the second reference voltage Vr2, step S14 is implemented to turn or hold on the heater 26. In this case, the control flow goes back to step S13. Steps S13 and S14 are repeatedly implemented until the temperature of the heating roller 25 is raised to the predetermined image fixing temperature T2.

It will be understood that the heater 26 is held off while the laser printer is in the TEMPERATURE-CONTROL-OFF mode, that is, after the predetermined time has passed after the printer is initially turned on or after the last printing operation or job. Consequently, a waste of electric power is minimized. It is also noted that the temperature of the heating roller 25 is controlled to be held at the predetermined stand-by temperature T1 (corresponding to the reference voltage Vr1) while the laser printer is in the stand-by mode, that is, while the laser printer is on but is not in a printing operation. In this respect, too, the amount of consumption of the electric power is reduced. It is further noted that the temperature of the heating roller 25 is controlled to be held at the predetermined image fixing temperature T2 (corresponding to the reference voltage Vr2), which is higher than the stand-by temperature T1 and suitable for the image fixing heating device 24 to heat or fuse the visible toner image on the sheet P for thereby fixing the toner on the sheet P.

Figure 5:
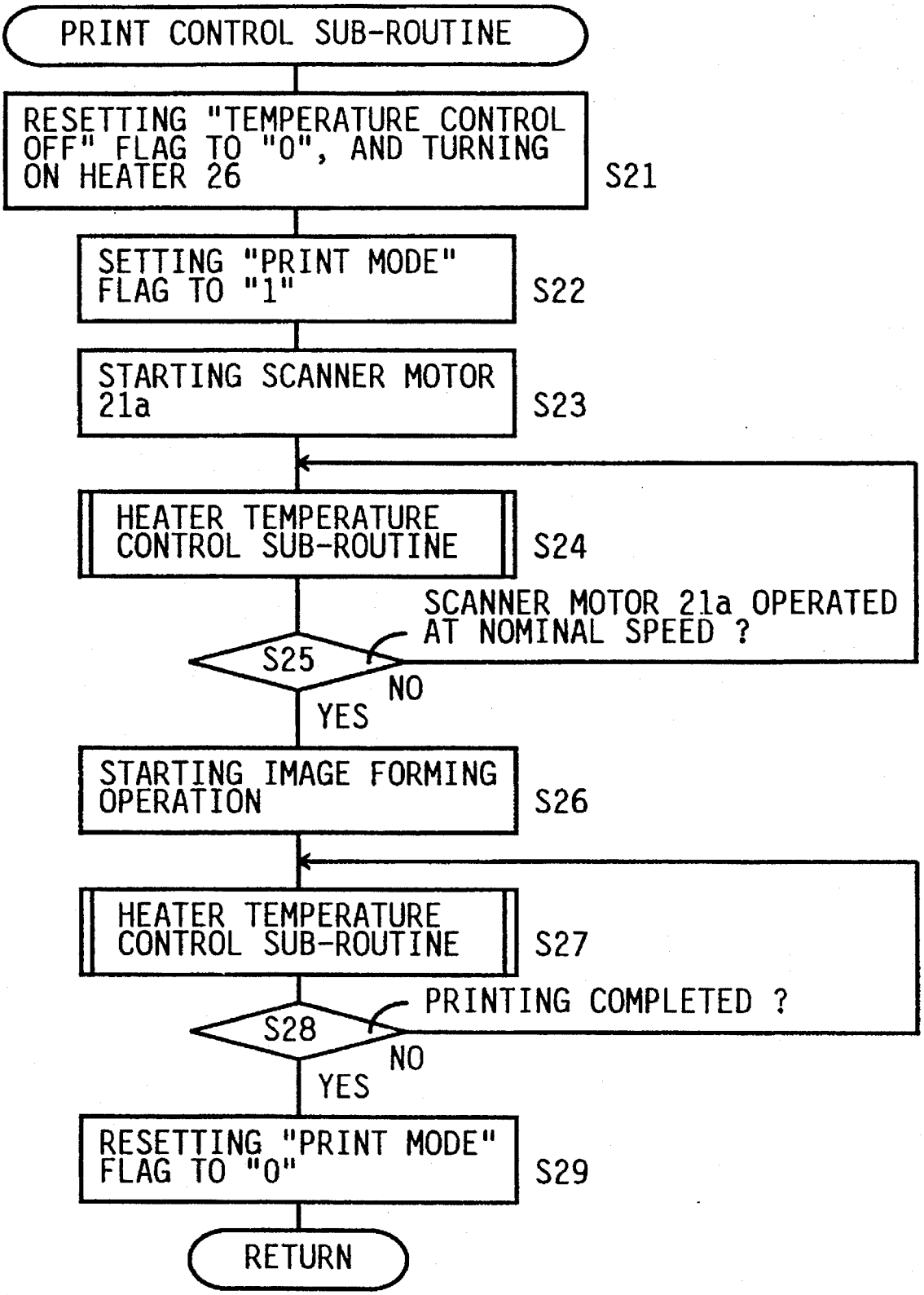
FIG. 5 is a flow chart showing a PRINT CONTROL sub-routine also executed in the main control routine of FIG. 3 to control a printing operation of the laser printer.

Referring next to the flow chart of FIG. 5, the PRINT CONTROL sub-routine for controlling the print operation of the laser printer is initiated with step S21 to reset the TEMPERATURE CONTROL OFF flag to "0" and turn on the heater 26. Then, step S22 is implemented to set the PRINT MODE flag to "1" to establish the printing mode. As described above, this flag is used in step S12 of the HEATER TEMPERATURE CONTROL sub-routine of FIG. 4. Step S22 is followed by step S23 to start the scanner motor 21*a* of the scanner unit 21.

Then, the control flow goes to step S24 to execute the HEATER TEMPERATURE CONTROL sub-routine of FIG. 4, which has been described above. As a result, the temperature of the heating roller 25 is raised to the image fixing temperature T2. After the sub-routine of FIG. 4 is executed, step S25 is implemented to determine whether the operating speed of the scanner motor 21*a* is raised to a predetermined speed. If a negative decision (NO) is obtained in step S24, the control flow returns to step S24 to execute the HEATER TEMPERATURE CONTROL sub-routine of FIG. 4 again. If an affirmative decision (YES) is obtained in step S25, that is, if the scanner motor 21*a* is operating at the predetermined or nominal speed, the control flow goes to step S26 to start an image forming operation according to the print data received from the video control circuit board 47. The image forming operation begins with feeding of the first sheet P.

After the image forming operation is started, step S27 is implemented to execute the HEATER TEMPERATURE CONTROL sub-routine of FIG. 4 again. Step S27 is followed by step S28 to determine whether the image forming operation is completed. If an affirmative decision (YES) is obtained in step S28, the control flow goes to step S29 to reset the PRINT MODE flag to "0", and the PRINT CONTROL sub-routine of FIG. 5 is terminated. If a negative decision (NO) is obtain in step S28, the control flow returns to step S27 to repeat steps S27 and S28 until the image forming operation is completed.

In the present embodiment of the invention, the laser printer is placed in the TEMPERATURE-CONTROL-OFF mode with the heater 26 held off, when a predetermined time has passed after the printer is initially turned on or after the last printing operation, whereby the amount of electric power consumption is minimized. If the PRINT START command is received from the external device 48 together with the print data while the printer is in the TEMPERATURE-CONTROL-OFF mode, the TEMPERATURE-CONTROL-ON mode and the print mode are established. As a result, the heater 26 is controlled to raise the temperature directly to the image fixing temperature T2, rather than to the stand-by temperature. At the same time, the scanner motor 21*a* of the scanner unit 21 is turned on. The present arrangement permits printing on the first delivered sheet P to be started in a comparatively short time after the PRINT START command is received in the temperature-control-off mode.

While the present invention has been described above in detail in its presently preferred embodiment, it is to be understood that the invention is not limited to the details of the illustrated embodiment, but may be otherwise embodied.

For instance, the TEMPERATURE CONTROL OFF flag may be set to "1" if an appropriate switch provided on an operator's control panel is turned on. In this case, step S2 is replaced by a step of determining whether the above-indicated switch is on or not. Alternatively, this step is added so that the TEMPERATURE CONTROL OFF flag is set to "1" either if the predetermined stand-by time $t_0$ has been detected by the timer 40*b* or if the above-indicated switch is operated.

Although the laser printer has been described as one form of the electrophotographic image forming apparatus, the principle of the present invention is equally applicable to a facsimile or telecopier system.

What is claimed is:

1. A method forming an image by electrophotography, comprising the steps of:

generating a visible image on a recording medium in response to a print start command;

activating a heating device to apply heat to said recording medium for fixing said visible image on said recording medium;

detecting a temperature adjacent to said heating device;

selectively establishing one of a temperature-control-on mode in which said temperature is controlled by said heating device, and a temperature-control-off mode in which said temperature is not controlled;

controlling said temperature in said temperature-control-on mode to be held at a first level when the apparatus is in a stand-by mode without said print start command being received, and at a second level higher than said first level when the apparatus is in a printing mode with said visible image being generated in response to said print start command and fixed by the heat generated by said heating device; and changing said temperature-control-off mode to said temperature-control-on mode to raise said temperature directly to said second level and establishing said printing mode without first establishing said first level of said stand-by mode, when said print start command is received and said temperature-control-off mode is established.

2. A method according to claim 1, wherein said step of generating a visible image comprises:

operating a scanning device to generate a latent image according to print data, said scanning device including a scanner motor, and generating said visible image on the basis of said latent image; and said method further comprises a step of activating said scanner motor upon activating said heating device when said print start command is received and said temperature-control-off mode is established.

3. An electrophotographic image forming apparatus comprising:

an image forming device for generating a visible image on a recording medium in response to a print start command;

a heating device for generating heat to be applied to said recording medium for fixing said visible image on said recording medium;

a temperature detector for detecting a temperature adjacent to said heating device;

a temperature-control mode setter for selectively establishing one of a temperature-control-on mode in which said heating device is controlled to control said temperature, and a temperature-control-off mode in which said heating device is not controlled; and a controller responsive to said temperature-control mode setter, for controlling said heating device when said temperature-control-on mode is selected, such that said temperature is held at a first level when the apparatus is in a stand-by mode without said print start command being received, and at a second level higher than said first level when the apparatus is in a printing mode with said image forming device being operated in response to said print start command, said controller holding said heating device in an off state when said temperature-control-off mode is selected, said controller changing said temperature-control-off mode to said temperature-control-on mode to raise said temperature directly to said second level and establishing said printing mode without first establishing said first level of said stand-by mode, when said print start command is received and said temperature-control-off mode is selected.

4. An electrophotographic image forming apparatus according to claim 3, further comprising a print-mode setter for establishing said stand-by mode when said print start command is not received, and establishing said printing mode when said print start command is received irrespective of whether the apparatus is placed in said temperature-control-on mode or said temperature-control-off mode.

5. An electrophotographic image forming apparatus according to claim 3, wherein said temperature-control mode setter establishes said temperature-control-off mode if the apparatus is held in said stand-by mode for more than a predetermined time without said print start command being received.

6. An electrophotographic image forming apparatus according to claim 3, wherein said mode setter establishes said temperature-control-off mode when an operator-controlled switch is operated.

7. An electrophotographic image forming apparatus according to claim 3, further comprising a memory for storing data representative of said first and second levels of said temperature.

8. An electrophotographic image forming apparatus according to claim 7, wherein said data representative of said first and second levels of said temperature consist of a first and a second reference value of an output of said temperature detector.

9. An electrophotographic image forming apparatus according to claim 3, further comprising a comparator for comparing said temperature detected by said temperature detector with said first and second levels, said controller controlling said heating device in said temperature-control-on mode on the basis of an output of said comparator.

10. An electrophotographic image forming means according to claim 3, further comprising a scanning device for generating a latent image according to print data, and wherein said image forming device generates said visible image on the basis of said latent image, and wherein said controller commands said image forming device to start an image forming operation after an operating speed of said scanning device is raised to a predetermined level after said temperature is raised to said second level.

11. An electrophotographic image forming apparatus according to claim 10, wherein said scanning device comprises a scanner motor for driving a polygon mirror for sweeping a laser beam modulated on the basis of said print data.

12. An electrophotographic image forming apparatus according to claim 3, wherein said controller comprises a memory for storing a main control routine for controlling an operation of the apparatus, said main control routine including a temperature control sub-routine for controlling said temperature in said temperature-control-on mode and not controlling said temperature in said temperature-control-off mode, said main control routine further including a print control sub-routine executed when said print start command is received, said print control sub-routine being formulated to change said temperature-control-off mode to said temperature-control-on mode and execute said temperature control sub-routine so that said temperature is controlled to be held at said second level when said print control sub-routine is executed.

13. An electrophotographic image forming apparatus according to claim 12, wherein said temperature-control mode setter comprises a temperature-control-off flag which is used in said temperature-control sub-routine to determine whether the apparatus is placed in said temperature-control-off mode or said temperature-control-on mode, said temperature-control-off flag is reset in said print control sub-routine to establish said temperature-control-on mode immediately after said print control sub-routine is initiated in response to said print start command.

14. An electrophotographic image forming apparatus according to claim 13, wherein said controller includes a print-mode flag which is set in said print control sub-routine to establish said printing mode immediately after said print control sub-routine is initiated in response to said print start command, so that said temperature is controlled to be held at said second level when said temperature control sub-routine is executed in said print control sub-routine, said print-mode flag being reset immediately before said print-control sub-routine is terminated.

15. An electrophotographic image forming apparatus according to claim 3, wherein said image forming device comprises a photosensitive drum on which said visible image is produced, and an image transfer device for transferring said visible image from said photosensitive drum onto said recording medium.

16. An electrophotographic image forming apparatus according to claim 3, wherein said heating device comprises a heating roller incorporating a heat generator, said recording medium being fed in rolling contact with said heating roller for fixing said visible image on said recording medium.

17. An electrophotographic image forming apparatus according to claim 3, wherein:

said image forming device comprises a scanning device for generating a latent image according to print data, said scanning device including a scanner motor, said image forming device generates said visible image on the basis of said latent image, and said controller activates said scanner motor as well as said heating device when said print start command is received and said temperature-control-off mode is selected.

* * * * *